United States Patent [19]

Franks

[11] 4,155,672

[45] May 22, 1979

[54] PROTECTIVE GUIDE CAGE CONSTRUCTION FOR SUBSEA WELL OPERATIONS

[75] Inventor: Neal S. Franks, Huntington Beach, Calif.

[73] Assignee: Deep Oil Technology, Inc., Long Beach, Calif.

[21] Appl. No.: 901,468

[22] Filed: May 1, 1978

[51] Int. Cl.[2] ..... E21B 33/035; F16L 1/00

[52] U.S. Cl. ..... 405/211; 405/188; 166/338; 166/342

[58] Field of Search ..... 405/187, 188, 203, 204, 405/211, 169; 166/335, 338, 311, 342, 366; 175/7

[56] References Cited

U.S. PATENT DOCUMENTS

| | | | |
|---|---|---|---|
| 3,316,015 | 5/1967 | Jones | 166/341 |
| 3,321,015 | 5/1967 | Word, Jr. | 166/342 X |
| 3,551,005 | 12/1970 | Brun | 166/341 X |
| 4,120,362 | 10/1978 | Chateau et al. | 166/339 |

*Primary Examiner*—Jacob Shapiro

*Attorney, Agent, or Firm*—Poms, Smith, Lande, Glenny & Rose

[57] ABSTRACT

A cage construction for protection of well equipment at a subsea wellhead and during descent to or ascent from a subsea well, said cage construction comprising an open frame cage body means defining a longitudinal axis, an intermediate cage portion of selected lateral and vertical dimension to encompass well equipment supported from a wellhead at the sea floor, and end cage portions extending upwardly and downwardly from said intermediate cage portion serving as guidance means, each cage end portion including coaxial receptor members, the receptor member at the lower end portion being adapted to receive and to be supported from a wellhead part, and the receptor member at the upper cage end portion being adapted to align, receive and pass therethrough the lower end of a pipe string into said cage body means.

7 Claims, 3 Drawing Figures

PROTECTIVE GUIDE CAGE CONSTRUCTION FOR SUBSEA WELL OPERATIONS

BACKGROUND OF THE INVENTION

Subsea wellheads include wellhead structure which projects above the sea floor surface and which may project above a well template seated on the sea floor. Such exposed wellhead equipment, if left exposed, may be subject to damage by various means during subsea well operation as by moving chains, cables, pipelines being repositioned or relocated during offshore well operations. Some prior proposed structures have been used to protect or guard such exposed wellhead equipment. Generally speaking, such prior proposed protective equipment was utilized for this sole function and was installed after the well equipment was associated with the subsea well.

SUMMARY OF INVENTION

The present invention relates to a novel protective guide cage construction for subsea well operations in which the protective cage is constructed to serve other functions in addition to the protective function. The invention particularly relates to a cage construction adapted for use with a template means of the type shown in copending application Serial No. owned by a common assignee.

The present invention generally contemplates an open frame cage body construction adapted to confine and protect subsea wellhead parts within its cage chamber, to include a cage construction adapted to be associated with well equipment while lowered to or lifted from a subsea well facilitating running and retrieving operations with respect to the wellhead, and constructed and arranged to facilitate alignment of equipment at the subsea wellhead.

The primary object of the present invention, therefore, is to provide a novel cage construction so designed as to facilitate other certain well operations.

An object of the present invention is to provide a protective cage construction adapted to be readily mounted on a wellhead part, such as a marine connector.

Another object of this invention is to provide a novel protective cage construction wherein receptor means are provided for receiving and guiding passage of a pipe string into the interior of the cage chamber and in alignment with a wellhead manderel.

A still further object of the present invention is to provide a novel protective cage construction adapted to protect well equipment during lowering of equipment to a wellhead and after wellhead equipment is installed.

Various other objects and advantages of the present invention will be readily apparent from the following description of the drawings in which an exemplary embodiment of the invention is shown.

IN THE DRAWINGS

Figure 1:
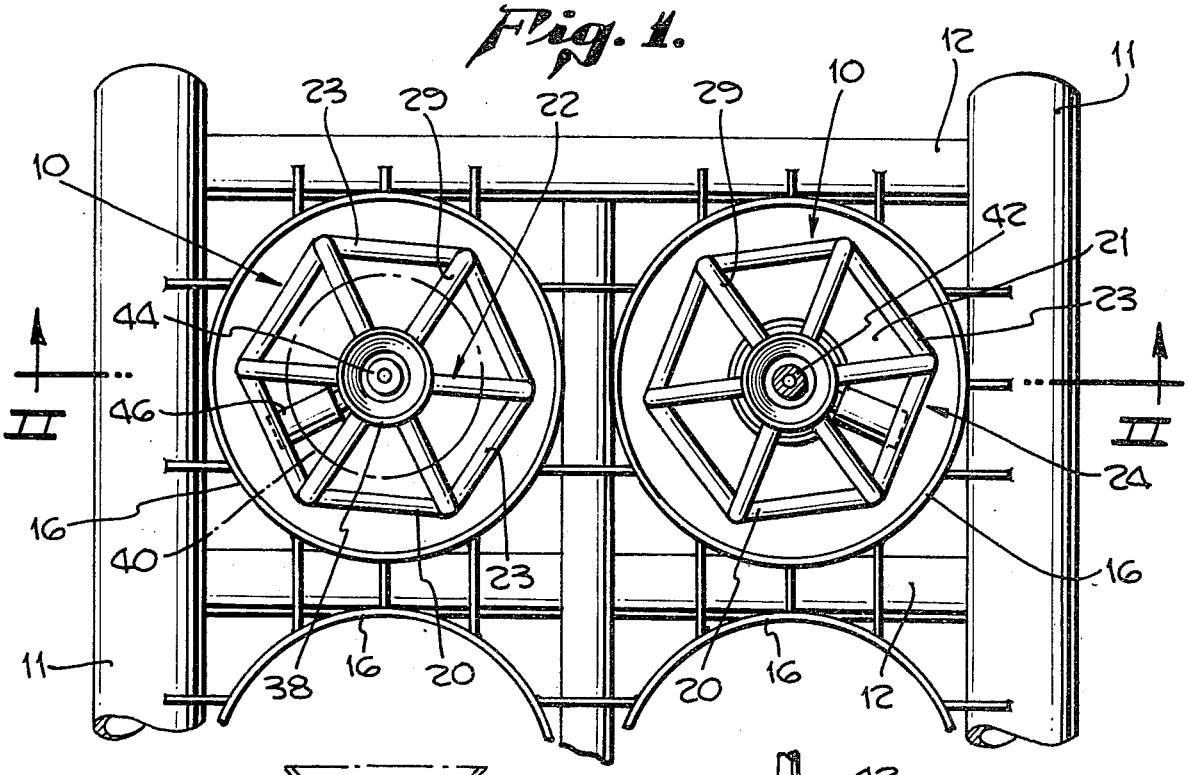
FIG. 1 is a fragmentary top plan view of a wellhead template means showing two well holes and wellheads therefor protected by a cage means of this invention.

In the drawings, a protective guide cage construction generally indicated at 10 is shown associated with a well template means 11 of the type described in copending application Serial No. 899,112 owned by a common assignee. Template means 11 generally comprises a template frame structure 12 supporting one or more guide funnels 14 from which extend wellhead mandrels 15. Production tubing and the casing string are supported from the wellhead equipment in usual manner. Template means 11 includes an annular latch ring 16 coaxially aligned with each wellhead mandrel 15, the latch ring serving a purpose as fully described and claimed in said copending application Ser. No. 899,112 It will be understood that template means 11 is exemplary only and that other template constructions may be provided.

Guide cage construction 10, in detail, comprises a cage body means 20 of open framework and defining a cage chamber 21. Cage 20 defines a longitudinal axis which is adapted to be aligned with a wellhead mandrel, such as 15.

Cage body means 20 comprises angularly spaced longitudinally extending cage members 22 lying in planes radial to the longitudinal axis of the cage construction and vertically spaced lateral cage members 23 lying in spaced planes transverse to the longitudinal axis of the cage construction. In this example, lateral members 23 define an intermediate cage portion 24 located downwardly off center from the opposite ends of the cage construction 10.

The longitudinal cage members 22 include lower cage portions 26 extending from the zone defined by lower lateral members 23 and converging toward the axis of the cage construction to thereby provide a lower tapered cage end portion generally indicated at 27. An upper tapered cage end portion 28 is similarly provided by cage member portions 29 which extend from the upper lateral member 23 and converge toward the upper axis of the cage construction.

Figure 3:
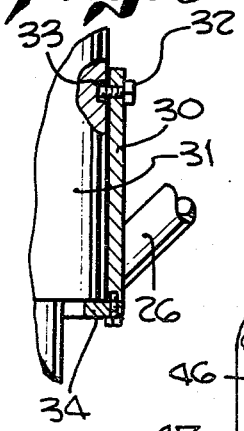
FIG. 3 is an enlarged fragmentary sectional view illustrating connectiong of the cage means to a marine connector or other well part.
Figure 2:
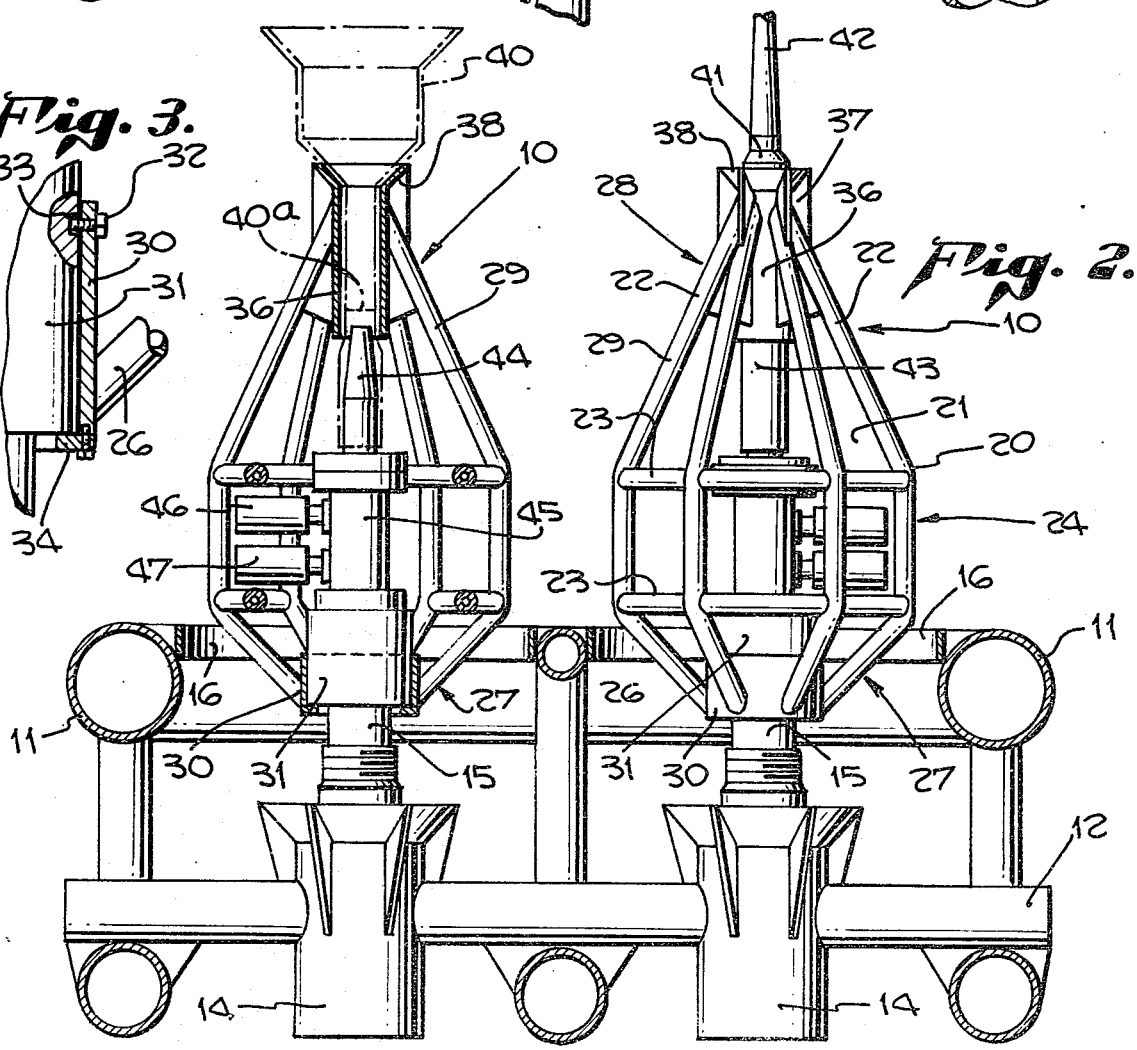
FIG. 2 is a fragmentary vertical sectional view taken in the plane indicated by line II—II of FIG. 1 showing the cage means of this invention.

At the lower end of the cage construction, end cage portion 27 including the converging cage members 26 may be welded to a cylindrical member 30 coaxial with said cage construction and adapted to receive therewithin part of a marine connector 31 connected to the wellhead mandrel 15. As best shown in FIG. 3, cylindrical member 30 is received over marine connector 31 and may be secured thereto by a plurality of circumferentially spaced bolts 32, the inner ends of which may be received within spaced bores 33 on the marine connector. A ring 34 may be secured to the bottom edge portion of member 30 to secure the cage to the marine connector 31. The cage may be lowered in association with connector 31 and the connector 31 mated with mandrel 15.

At the upper end of the cage, an elongated cylindrical member 36 is supported from the inclined cage member portions 29 and by suitable reinforcing gusset plates 37. The upper end 38 of cylindrical member 36 is outwardly flared and is adapted to provide a seat for an abandonment cap 40 as described in said copending application Ser. No. 899,112. Abandonment cap 40 extends through member 36 and has a lower portion receiving and protecting connector 44 on safety block means 45. Cap 40 also has an internal closure wall **40*a***.

The outwardly flared upper end 38 also provides a guide for the lower end 41 of a pipe string or riser string 42. The inner diameter of cylindrical member 36 is sufficient so as to receive and pass therethrough the lower end 41 of pipe string 42, the lower end 41 including a riser connector 43 for connection to a mating connector 44 provided on top of a safety valve block means 45, such as also described in said copending application.

Safety valve block means 45 includes valve actuators 46 and 47 which may assembled with the block means 45 after the cage is assembled and connected to the marine connector 31. In this respect it will be noted that the marine connector 31 and the block means 45 (without the valve actuators 46,47) may readily be received in the lower cylindrical member 30 of the cage means.

In this example of the cage construction of this invention, FIG. 1 illustrates the cross-sectional shape of the cage defined by the lateral cage members 23 to be of hexagonal shape. It will, of course, be understood that the cross-sectional shape of the intermediate cage portion 24 may be of any polygonal or circular cross-section.

The cage construction 10 provided with its lower tapered end portion 27 facilitates guiding of the cage construction 10 into coaxial alignment with wellhead mandrel 15 when it is being initially lowered into assembly with the template means. A guide base frame latched to ring 16 may have a circular or cylindrical guide member which may closely cooperate with the lower tapered end portion 27 in order to achieve coaxial alignment of the cage construction with the wellhead. The upper tapered end portion 28 of the cage construction facilitates guiding a guide base frame into latched engagement with ring 16 as described in said copending application Serial No. 899,112. Thus, the cage construction 10 not only provides a protective function for block means 45 and actuator valves therefor contained within cage chamber 21, but also facilitates guiding and coaxial alignment of the cage with the wellhead and other well equipment which may be associated with the template means 11. It should be noted that the reinforcement of the converging upper cage member portions 29 at the cylindrical member 36 provides a rigid strong upper end portion which will maintain the cylindrical receptor member 36 in proper coaxial alignment with the lower cylindrical receptor member 30.

As shown in the drawings, cage 10 may extend within the top of the well template structure and cooperates therewith in protecting well equipment. Cage 10 is readily associated with safety valve block means 45, as shown, with a maneuverable tool means as shown in copending application Ser. No. 900,500, and with other well equipment to be lowered to the sea floor. During lowering and retrieving of such well parts, the cage 10 provides protection to such parts during descent and ascent thereof particularly where multiple risers are in relatively close relation.

It will be understood that various modifications and changes may be made in the protective cage construction described above and which may fall within the spirit of this invention and all such changes and modifications coming within the scope of the appended claims are embraced by it.

I claim:

1. A protective guide cage construction for subsea well operations comprising:

a cage body means having a longitudinal axis and including angularly spaced longitudinally extending cage members lying in radial planes, and lateral cage members spaced from said longitudinal axis and lying in transverse planes, said lateral cage members interconnecting intermediate portions of said longitudinally extending cage members to provide a cage chamber;

said longitudinal cage members including end portions converging toward said axis;

and a receptor member carried by said converging end portions at each end of said cage body means in coaxial relation with said axis, one of said receptor means being adapted to receive and be connected to a wellhead part for supporting said cage body member.

2. A cage construction as claimed in claim 1 wherein one of said receptor means comprises a cylindrical member for guiding reception and passage therethrough of a lower end of a riser pipe string.

3. A cage construction as claimed in claim 1 wherein said converging longitudinal cage members provide alignment and guidance means for guide base frame means to be associated with a well template means.

4. A cage construction as claimed in claim 1 wherein said lateral cage members and said longitudinal cage members provide alignment means for certain well equipment to be associated therewith.

5. In a protective cage construction for subsea well operations the combination of:

a cage body means having a longitudinal axis and of open frame construction;

means at one end of said cage body means for reception and passage therethrough of the lower end of a pipe string into said cage body means;

means at the other end of said cage body means for reception of a wellhead part for supporting said cage body means.

6. In a cage construction as claimed in claim 5 wherein said end means at each end of said cage body means converging from an intermediate cage body portion to said axis to serve as guidance means for associated well equipment.

7. A cage construction for subsea well operations substantially as shown and described.

* * * * *